US010006616B2

(12) United States Patent
Braatz et al.

(10) Patent No.: US 10,006,616 B2
(45) Date of Patent: Jun. 26, 2018

(54) DEVICE AND METHOD FOR MONITORING A SIGNAL EMITTER COMPRISING A LIGHT-EMITTING DIODE IN A LIGHT-SIGNAL SYSTEM

(71) Applicant: SIEMENS AKTIENGESELLSCHAFT, Munich (DE)

(72) Inventors: Robert Braatz, Germering (DE); Heiko Junker, Markt Schwaben (DE); Robert Runge, Antdorf (DE); Geert De Zaeyer, Markt Schwaben (DE)

(73) Assignee: Siemens Aktiengesellschaft, Munich (DE)

( * ) Notice: Subject to any disclaimer, the term of this patent is extended or adjusted under 35 U.S.C. 154(b) by 0 days. days.

(21) Appl. No.: 15/515,268

(22) PCT Filed: Sep. 17, 2015

(86) PCT No.: PCT/EP2015/071274
§ 371 (c)(1),
(2) Date: Mar. 29, 2017

(87) PCT Pub. No.: WO2016/050521
PCT Pub. Date: Apr. 7, 2016

(65) Prior Publication Data

US 2017/0227203 A1 Aug. 10, 2017

(30) Foreign Application Priority Data

Sep. 29, 2014 (DE) ..... 10 2014 219 688

(51) Int. Cl.
*G05F 1/00* (2006.01)
*F21V 23/04* (2006.01)
(Continued)

(52) U.S. Cl.
CPC ..... *F21V 23/0457* (2013.01); *H05B 33/0833* (2013.01); *H05B 33/0842* (2013.01);
(Continued)

(58) Field of Classification Search
CPC ..... H05B 33/0815; H05B 33/0818; H05B 41/2828; H05B 41/3921; H05B 41/3927;
(Continued)

(56) References Cited

U.S. PATENT DOCUMENTS 9,235,899 B1 * 1/2016 Kirmani ..... H04N 5/33
2004/0212309 A1 10/2004 St.-Germain
(Continued)

FOREIGN PATENT DOCUMENTS

DE 10208462 A1 9/2003
DE 102010005088 A1 7/2011
(Continued)

*Primary Examiner* — Minh D A
(74) *Attorney, Agent, or Firm* — Laurence Greenberg; Werner Stemer; Ralph Locher

(57) ABSTRACT

An apparatus for monitoring a signal transmitter for a traffic control signal installation. The signal transmitter has a light-emitting diode. The monitoring apparatus includes: a two-channel measuring device for measuring an actual light intensity of the light which is emitted by the diode and for measuring at least one electrical characteristic variable of the diode, and a control device for operating the signal transmitter depending on the measured actual light intensity and the measured electrical characteristic variable. There is also described a corresponding method, a signal transmitter, a traffic control signal installation and a computer program.

22 Claims, 2 Drawing Sheets

(51) Int. Cl.
*H05B 33/08* (2006.01)
*F21Y 115/10* (2016.01)

(52) U.S. Cl.
CPC ..... *H05B 33/0851* (2013.01); *B61L 2207/02* (2013.01); *F21Y 2115/10* (2016.08); *H05B 33/0827* (2013.01)

(58) Field of Classification Search
CPC .. H05B 37/029; H05B 37/02; H05B 37/0254; H05B 33/0803; H05B 33/0827; H05B 33/0851; H05B 33/083; F21Y 2101/02; B23K 9/0732
See application file for complete search history.

(56) References Cited

U.S. PATENT DOCUMENTS

| | | | | |
|---|---|---|---|---|
| 2013/0099933 | A1 | 4/2013 | Berg et al. | |
| 2013/0336360 | A1 | 12/2013 | Pauritsch et al. | |
| 2013/0338947 | A1* | 12/2013 | John ..... | H02J 7/35 702/60 |

FOREIGN PATENT DOCUMENTS

| | | | |
|---|---|---|---|
| DE | 102010026012 | A1 | 12/2011 |
| EP | 1341402 | A2 | 9/2003 |
| EP | 2677387 | A1 | 12/2013 |
| EP | 2677841 | A1 | 12/2013 |
| WO | 2004070675 | A2 | 8/2004 |
| WO | 2007006684 | A1 | 1/2007 |

* cited by examiner

DEVICE AND METHOD FOR MONITORING A SIGNAL EMITTER COMPRISING A LIGHT-EMITTING DIODE IN A LIGHT-SIGNAL SYSTEM

BACKGROUND OF THE INVENTION

Field of the Invention

The invention relates to a device and a method for monitoring a signal emitter comprising a light-emitting diode in a light-signal system. The invention further relates to a light-signal system and a computer program.

In known LED ("light emitting diode") signal emitters in light-signal systems, as a rule only electrical parameters are measured. It is not possible to detect a reduction in the brightness of the LED and the observance of the standards relating to the minimum light requirements derived therefrom. This means it is necessary to replace the LED-signal emitter at regular intervals by way of precaution.

Here, the drawback is in particular the fact that, due to the specified replacement intervals, an LED signal emitter is also replaced when it is not at all necessary, i.e. when the LED signal emitter is still emitting light with a sufficient intensity. This results in unnecessary costs, increased expenditure on maintenance and unnecessary expenditure on materials.

Known from published patent application DE 10 2010 005 088 A1 is a light signal, in particular a railroad light signal, with at least one LED, wherein means for the measurement and regulation of the luminous intensity to a predetermined setpoint value in a way which is reliable in terms of signal technology are provided.

Published patent application EP 2 677 387 A1 discloses a light signal arrangement, in particular a railway light signal arrangement.

Published patent application DE 10 2010 026 012 A1 discloses an LED light signal.

Published patent application DE 102 08 462 A1 discloses a lighting arrangement.

SUMMARY OF THE INVENTION

The object on which the invention is based can be considered to be a device for monitoring a signal emitter comprising a light-emitting diode for a light-signal system that overcomes the known drawbacks.

The object on which the invention is based can also be considered to be a corresponding method for monitoring a signal emitter comprising a light-emitting diode (for example a light-signal system).

The object on which the invention is based can further be considered to be the disclosure of a corresponding signal emitter (for example for a light-signal system).

The object on which the invention is based can furthermore be considered to be the disclosure of a corresponding computer program.

These objects are achieved by means of the respective subject matter of the independent claims. Advantageous embodiments of the invention are in each case the subject matter of dependent subclaims.

According to one aspect, a device for monitoring a signal emitter comprising a light-emitting diode for a light-signal system is provided comprising: a measuring unit for measuring an actual light intensity of the light emitted by means of the diode light and for measuring at least one electrical parameter of the diode and a two-channel control unit to operate the signal emitter as a function of the measured actual light intensity and the measured electrical parameter.

According to a further aspect, a method for monitoring a signal emitter comprising a light-emitting diode (for example for a light-signal system) is provided comprising the following steps: measuring an actual light intensity of the light emitted by means of the diode and at least one electrical parameter of the diode and operating the signal emitter as a function of the measured actual light intensity and the measured electrical parameter.

According to another aspect, a signal emitter is provided comprising: a signal chamber comprising a light-emitting diode and a device for monitoring a signal emitter comprising a light-emitting diode in a light-signal system.

According to a further aspect, a light-signal system comprising the signal emitter according to the invention is provided.

According to another aspect, a computer program is provided comprising a program code for carrying out the method for monitoring a signal emitter comprising a light-emitting diode in a light-signal system when the computer program is executed on a computer, preferably on a control unit.

Therefore, the invention in particular comprises the concept of measuring an intensity of the light, which is emitted by means of the diode. The result of the measurement, that is the actual light intensity, is used as a criterion for operating the signal emitter. This means that the signal emitter is operated as a function of the measured actual light intensity. Therefore, the monitoring of the signal emitter is in particular optical monitoring. This in particular achieves the technical advantage that it is possible to detect when the statutory minimum light requirements can no longer be met due to a reduction in the brightness of the light-emitting diode, for example due to ageing or a high ambient temperature. It is, therefore, advantageously possible to determine whether or not the light-emitting diode needs to be replaced. Therefore, there is no longer any need for defined replacement intervals. This advantageously reduces expenditure on servicing and also reduces costs and expenditure on materials.

The invention furthermore comprises the concept that, in addition to optical monitoring, electrical monitoring is also performed in so far as, in addition to the measurement of the actual light intensity, at least one electrical parameter of the diode is measured, wherein the diode is then operated on the basis of both the measured actual light intensity and the electrical parameter. This in particular achieves the technical advantage that it is possible to carry out efficient monitoring.

In particular, the monitoring of both the actual light intensity and the electrical parameter(s) advantageously achieves higher reliability and higher safety. This is because measurement of the electrical parameter alone does not provide any information on whether there is enough light for the intended or correct operation or whether any light at all is being emitted.

The fact that the control unit is embodied with two channels in particular has the technical advantage that it is possible to ensure a high safety level. This is because, due to the presence of two channels, the two channels are able to monitor one another, in particular for errors.

For example, the control unit comprises two processors (first and second processor, as described below), embodied, for example, to monitor one another, in particular for errors. In an error scenario, it is provided according to one embodiment that the two processors switch off the signal emitter, in particular the light-signal system, for example the diode independently of one another. This is done, for example, via an electronic switch, which produces a short-circuit when switched, i.e. is embodied to produce a short-circuit when switched, wherein the short-circuit triggers a fuse arranged upstream of the control unit. Therefore, this means that in an error scenario, the two processors independently of one another, have the possibility of producing a short-circuit that triggers the upstream fuse via the electronic switch.

According to one embodiment, the operation of the signal emitter comprises the actuation of a driver circuit of the diode. The driver circuit can also be called an LED driver. This means that it is provided according to one embodiment that the control unit is embodied to actuate a driver circuit of the diode. The driver circuit comprises, for example, a power driver.

According to one embodiment, the actuation of the driver circuit comprises the fact that the driver circuit is actuated such that an actual light intensity is increased or decreased, generally that an actual light intensity is set or regulated to a predetermined desired light intensity.

The at least one electrical parameter comprises, for example, an electrical current and/or an electrical voltage. This means, for example, that an electrical current is measured, which flows through the diode during operation. For example, in addition or instead, an electrical voltage is measured which is applied to the diode or will applied to the diode during operation.

Light-emitting diode may hereinafter also be abbreviated to can LED. LED stands for "light emitting diode".

For the purposes of the present invention, a signal emitter comprises in particular one or more signal chambers, in which the one or more LEDs are preferably arranged.

When the description mentions LEDs of the signal emitter, this always means that this entails the LEDs in the signal chambers or signal chamber.

When the description mentions a signal emitter of a light-signal system, this always means that that only the signal emitter as such is disclosed, i.e. separate from the light-signal system. Hence, the wording "signal emitter of a light-signal system" also includes the following: signal emitter for a light-signal system.

According to one embodiment, the signal emitter comprises a plurality of light-emitting diodes. The explanations relating to one LED apply analogously to a plurality of LEDs and vice versa. The monitoring of a plurality of LEDs is performed analogously to the monitoring of one LED.

According to one embodiment, the light-signal system comprises a plurality of signal emitters each comprising one or more light-emitting diodes. The monitoring of this plurality of signal emitters is performed analogously to the monitoring of one signal emitter. The corresponding explanations apply analogously.

In one embodiment it is provided that the control unit comprises a first processor and a second processor, wherein the first processor is embodied on the basis of the measured actual light intensity and the measured electrical parameter to actuate a driver circuit of the diode, wherein the second processor is embodied to monitor the first processor during operation for an error and, on the detection of an error, to switch off the diode.

This in particular achieves the technical advantage that an error in the first processor does not result in damage to the diode.

According to one embodiment, it is provided that each of the two processors is provided with its own voltage regulator for a respective electrical supply voltage for the two processors.

This in particular achieves the technical advantage that a failure of one voltage regulator does not have the result that the two processors can no longer be supplied with electric voltage.

According to a further embodiment, it is provided that the second processor is embodied to switch the diode off for a function test on the first processor, wherein the second processor is embodied, in the absence of an error message from the first processor that the diode is not functioning, to prevent the diode from being switched back on.

This in particular achieves the technical advantage that the first processor can be checked efficiently for a malfunction. This is because, if the first processor is functioning faultlessly, it would have to recognize the switched-off diode due to the measured actual light intensity and the measured electrical parameter (both of which should produce zero within the limits of the measuring accuracy) and output a corresponding error message that the diode is not functioning. If the first processor does not do this, the second processor assumes that the first processor has a fault and, for reasons of safety, leaves the diode switched off, i.e. prevents the diode from switching back on.

It is provided according to another embodiment that the first processor is embodied to send a data packet to the second processor and, in the absence of a response packet from the second processor, to switch off the diode and/or that the second processor is embodied to send a data packet to the first processor and, in the absence of a response packet from the first processor, to switch off the diode.

This in particular achieves the technical advantage that the two processors are able to monitor one another efficiently, i.e. check one another for reliability of performance. Thus, for example, the first processor sends a data packet to the second processor. If, within a predetermined time after the transmission of the data packet, there is no response (response data packet) from the second processor, i.e. if there is no response data packet within the predetermined time, the first processor assumes that the second processor has a fault and switches the diode off for safety reasons. This applies analogously to the reverse case: the second processor sends a data packet to the first processor.

It is provided in one embodiment that the first and/or the second processor is/are embodied, in an error scenario to switch off the signal emitter, in particular the diode, in particular to switch off irreversibly. Irreversible switching-off comprises, for example, the triggering of a fuse cut-out (blow-out of the fuse cut-out) in an electric circuit of the signal emitter, in particular in an electric circuit of the diode.

For example, the first and/or the second processor is/are embodied, in an error scenario to generate an EOL signal in order to switch off the signal emitter, in particular the diode, irreversibly. "EOL" stands for "end of life".

An error scenario comprises in particular that the first and/or the second processor has/have detected an error. The error can, for example, have occurred in one of the two processors.

According to one embodiment, it is provided that the control unit is embodied to regulate the actual light intensity to a predetermined greater desired light intensity if the measured actual light intensity is below a predetermined light-intensity threshold. This in particular achieves the technical advantage that a minimum light intensity is always emitted in so far that regulation to the predetermined desired light intensity takes place if the measured actual light intensity is below the predetermined light-intensity threshold. The predetermined greater desired light intensity usually corresponds to the minimum light intensity according to the statutory requirements. Here, "greater" refers in particular to a case when the predetermined desired light intensity is greater than the measured actual light intensity. Therefore, this means that the light intensity of the light emitted is increased if the measured actual light intensity is below a predetermined light-intensity threshold.

It is provided according to one embodiment that the control unit is embodied to switch off the signal emitter if the actual light intensity cannot be regulated to the predetermined desired light intensity. This in particular achieves the technical advantage that it prevents the signal emitter from being operated when a predetermined brightness can no longer be achieved. This advantageously enables adherence to standards relating to the minimum light requirements. In particular, it is provided that the light-signal system is switched off or enters an error condition. In particular, it is provided that an error signal is formed, which, for example, can be sent to a central control computer so that it can be established that the light-signal system is no longer working correctly.

It is provided according to a further embodiment that the measuring unit comprises a light sensor and the control unit comprises a processing unit which is embodied to subtract a light signal measured by means of the light sensor when the diode is switched off from a light signal measured by means of the light sensor when the diode is switched on in order to form a subtracted light signal corresponding to the measured actual light intensity. This in particular achieves the technical advantage that, when the diode is switched off, an extraneous light signal can be measured so that, when the diode is switched on, the light flux from the LED can be calculated by means of a simple subtraction. This also advantageously enables an extraneous light signal in the light signal to be removed. This advantageously increases a signal-to-noise ratio.

According to one embodiment, the processing unit comprises the first and/or the second processor.

For example, the first and/or the second processor is/are embodied to subtract the light signal measured by means of the light sensor when the diode is switched off from the light signal measured by means of the light sensor when the diode is switched on in order to form the subtracted light signal corresponding to the measured actual light intensity.

For example, the first and/or the second processor is/are embodied to switch off the signal emitter, in particular the diode, if the actual light intensity cannot be regulated to the predetermined desired light intensity.

It is provided according to one embodiment, in order to measure the light signals when the diode is switched off and switched on, that the control unit is embodied to switch the diode on and off periodically wherein the period is within the millisecond range. Therefore, a lock-in measurement is performed. This in particular achieves the technical advantage that it can be reliably established that the detected light also actually originates from the LED and not, for example, from the light penetrating from the outside (extraneous light). This is because, since it is known when the LED should or should not be illuminated, this can be checked in the correspondingly measured light signal. The period is therefore within the millisecond range since here, as a rule, a human eye is too slow to detect this periodic switching-on and switching-off. Hence, the monitoring, that is the measurement, can be performed without interruption during the normal operation of the light-signal system.

For example, it is provided according to one embodiment that the first and/or the second processor is/are embodied, in order to measure the light signals when the diode is switched off and switched on, to switch the diode on and off periodically, wherein the period is within the millisecond range.

It is provided according to a further embodiment that a temperature sensor is provided in order to measure a temperature of an environment of the signal emitter, wherein the control unit is embodied to operate the signal emitter as a function of the measured temperature. This in particular achieves the technical advantage that yet another parameter can be used to operate the signal emitter. This can advantageously achieve that the signal emitter can be operated even more efficiently. In particular, this enables it to be detected whether there is an insufficient light flux due to the fact that the ambient temperature is over-high. Here, over-high ambient temperature in particular means that the ambient temperature is outside the specifications for the LED. Analogously, this obviously also applies to temperatures that are too low.

For example, it is provided according to one embodiment that the first and/or the second processor is/are embodied to actuate a driver circuit of the diode on the basis of the measured temperature.

It is provided in one embodiment that the first and/or the second processor is/are embodied to actuate a driver circuit of the diode on the basis of the measured actual light intensity and on the basis of the measured electrical parameter.

In one embodiment, the first and/or the second processor is/are each embodied as a microcontroller (μC).

According to a further embodiment, it is provided that the measuring unit comprises a light sensor, wherein a fiber-optic conductor is provided in order to conduct a part of the light emitted to the light sensor. This in particular achieves the technical advantage that the measuring site can be different from the site or position of the LED. Therefore, this means that the light sensor can be arranged independently of the light-emitting diode arranged. This advantageously achieves greater flexibility in the construction of the signal emitter.

It is provided according to one embodiment that the measuring unit comprises a light sensor. The light sensor is in particular a photodiode. In particular, a plurality of light sensors, in particular a plurality of photodiodes, is provided.

It is provided in one embodiment that the device for monitoring a signal emitter comprising a light-emitting diode for a light-signal system is embodied or configured to execute or perform the method for monitoring a signal emitter comprising a light-emitting diode for a light-signal system.

It is provided in one embodiment that the method for monitoring a signal emitter comprising a light-emitting diode for a light-signal system is executed or performed by means of the device for monitoring a signal emitter comprising a light-emitting diode for a light-signal system.

Technical functions of the device may be derived directly from corresponding functions of the method and vice versa.

It is provided in one embodiment that the operation includes the feature that a driver circuit of the diode is actuated by means of a first processor on the basis of the measured actual light intensity and the measured electrical parameter, wherein the first processor is monitored for an error during operation by means of a second processor, wherein the second processor switches off the diode on the detection of an error.

It is provided in a further embodiment that a respective electrical supply voltage for the two processors is provided by means of their own voltage regulators.

It is provided in another embodiment that the second processor switches the diode off for a function test on the first processor and, in the absence of an error message from the first processor that the diode is not functioning, prevents the diode from being switched back on.

According to a further embodiment it is provided that the first processor sends a data packet to the second processor and, in the absence of a response packet from the second processor, switches off the diode and/or wherein the second processor sends a data packet to the first processor and, in the absence of a response packet from the first processor, switches off the diode.

It is provided according to one embodiment, that operation includes the regulation of the actual light intensity to a predetermined greater desired light intensity if the measured actual light intensity is below a predetermined light-intensity threshold.

According to yet another embodiment, it is provided that the signal emitter, in particular the light-signal system, is switched off if the actual light intensity cannot be regulated to the predetermined desired light intensity.

According to yet another embodiment, it is provided that a light sensor is used for the measuring, wherein a light signal measured by means of the light sensor when the diode is switched off is subtracted from a light signal measured by means of the light sensor when the diode is switched on in order to form a subtracted light signal corresponding to the measured actual light intensity.

According to a further embodiment, it is provided that in order to measure the light signals when the diode is switched off and switched on, the diode is periodically switched on and off, wherein the period is within the millisecond range.

According to yet another embodiment, it is provided that a temperature of an environment of the signal emitter is measured and the signal emitter is operated as a function of the measured temperature.

According to yet another embodiment, it is provided that a light sensor is used for the measuring and a part of the light emitted is guided to the light sensor by means of a fiber-optic conductor.

Embodiments relating to the method can be derived analogously from embodiments relating to the device and vice versa. Corresponding explanations, technical advantages and features relating to the method apply analogously to the device and vice versa.

The above-described properties, features and advantages of this invention and manner in which these are achieved are explained more clearly and understandably in conjunction with the following description of the exemplary embodiments, which are explained with reference to the drawing, which shows

DESCRIPTION OF THE INVENTION

Figure 1:
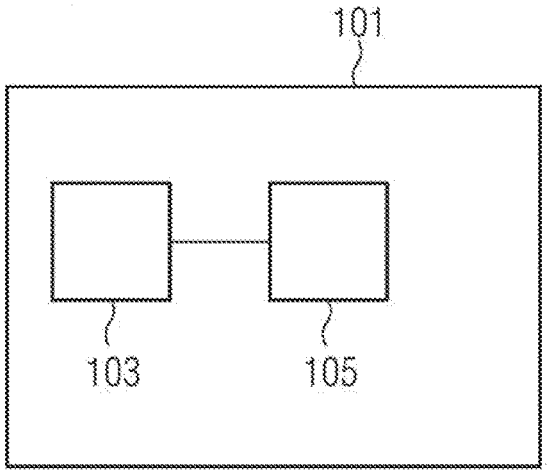
FIG. 1 a device for monitoring a signal emitter comprising a light-emitting diode in a light-signal system, FIG. 2 a flow diagram of a method for monitoring a signal emitter comprising a light-emitting diode in a light-signal system, FIG. 3 a signal emitter, FIG. 4 an evaluation of a light signal measures by means of a photodiode and FIG. 5 a further device for monitoring a signal emitter comprising a light-emitting diode in a light-signal system.

In the following, the same reference characters may be used for the same features.

FIG. 1 shows a device 101 for monitoring a signal emitter comprising a light-emitting diode in a light-signal system (not shown).

The device 101 comprises a measuring unit 103 in order to measure an actual light intensity of the light emitted by means of the diode and in order to measure at least one electrical parameter of the diode. For example, the measuring unit 103 comprises a light sensor, preferably a photodiode. The measuring unit 103 comprises, for example, a voltage sensor and/or a current sensor.

The device 101 also comprises a two-channel control unit 105 to operate the signal emitter as a function of the measured actual light intensity and as a function of the measured electrical parameter.

In an embodiment that is not shown, the device 101 comprises a fiber-optic conductor to conduct a part of the light emitted to the measuring unit 103, preferably to the light sensor.

Figure 2:
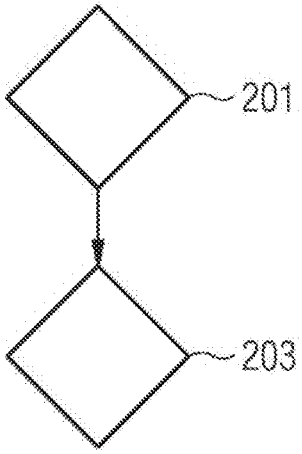

FIG. 2 is a flow diagram of a method for monitoring a signal emitter comprising a light-emitting diode in a light-signal system.

According to a step 201, an actual light intensity of the light emitted by means of the diode and at least one electrical parameter of the diode are measured. The measurement of the actual light intensity and the measurement of the at least one electrical parameter are, for example, performed simultaneously or preferably sequentially. In a step 203, the signal emitter is operated as a function of the measured actual light intensity and as a function of the measured electrical parameter.

The at least one electrical parameter comprises, for example, an electrical current and/or an electrical voltage. The measured parameters are used as a further basis for the operation of the signal emitter. Therefore, this means that, in addition to the measured actual light intensity, the signal emitter is operated on the basis of the measured electrical parameter or parameters.

Figure 3:
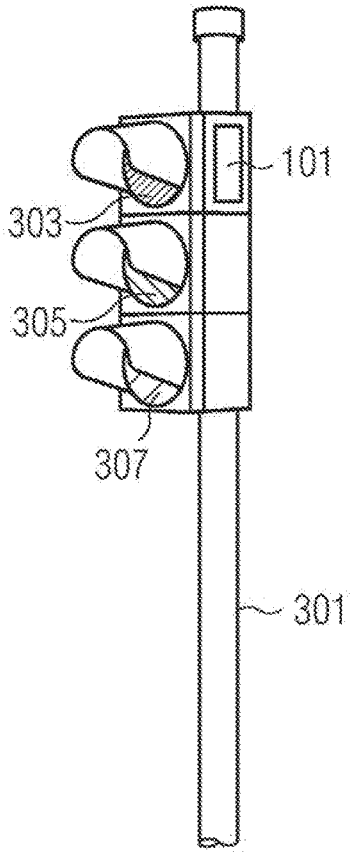

FIG. 3 shows a signal emitter 301 (for, for example, a light-signal system).

The signal emitter 301 comprises three signal chambers 303, 305, 307 each comprising at least one, preferably more, light-emitting diode. The signal emitter 301 further comprises a device 101 according to FIG. 1 for each of the three signal chambers 303, 305, 307. For reasons of clarity, the measuring unit 103 and the control unit 105 are not shown in FIG. 3. The signal emitter 301 is, for example, included in a light-signal system.

The device 101 monitors the respective light-emitting diodes of the three signal chambers 303, 305 and 307 in that corresponding actual light intensities and electrical parameters are measured so that then the diodes of the individual signal chambers 303, 305, 307 are measured on the basis of the measured actual light intensities and the measured parameters.

Figure 4:
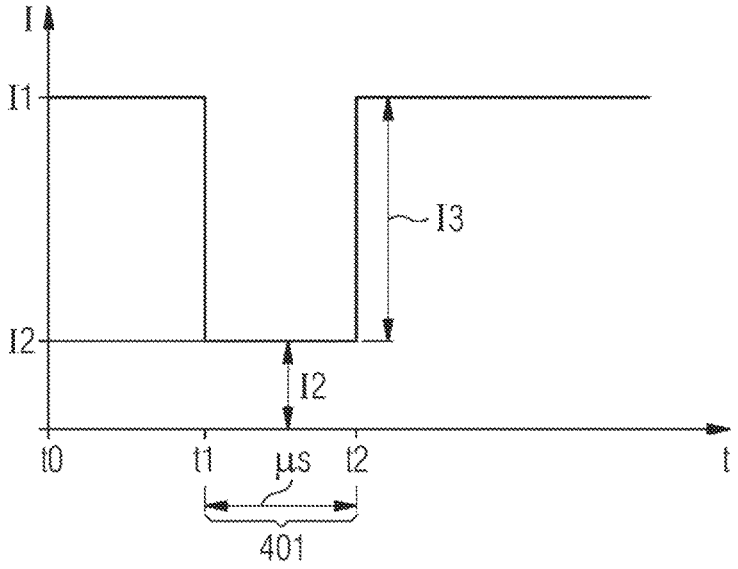

FIG. 4 shows an evaluation of a light signal measured by means of a photodiode.

The intensity I of the measured light signal is plotted over the time t. From time t0 to t1, the diode of the signal emitter is switched on. A light intensity I1 is measured. This is usually made up of the light emitted by means of the diode and the diode's extraneous light. In order to be able to subtract the proportion of the extraneous light, i.e. the ambient light, it is provided that the diode is switched off in the time interval between t1 and t2. This time interval is within in the microsecond range. Therefore, a light intensity I2 is measured when the diode is switched off. The diode is switched back on after the time t2. It is preferably provided that the switching-on and switching-off is performed periodically. The time interval is identified with the reference number 401.

The actual light intensity, i.e. the light signal, which originates exclusively from the photodiode, is now obtained by subtracting I2 from I1. Here, the subtracted signal is represented symbolically means of a double arrow, wherein "I3" on this double arrow is an indication that this is the actual light intensity of the light of the diode.

Figure 5:
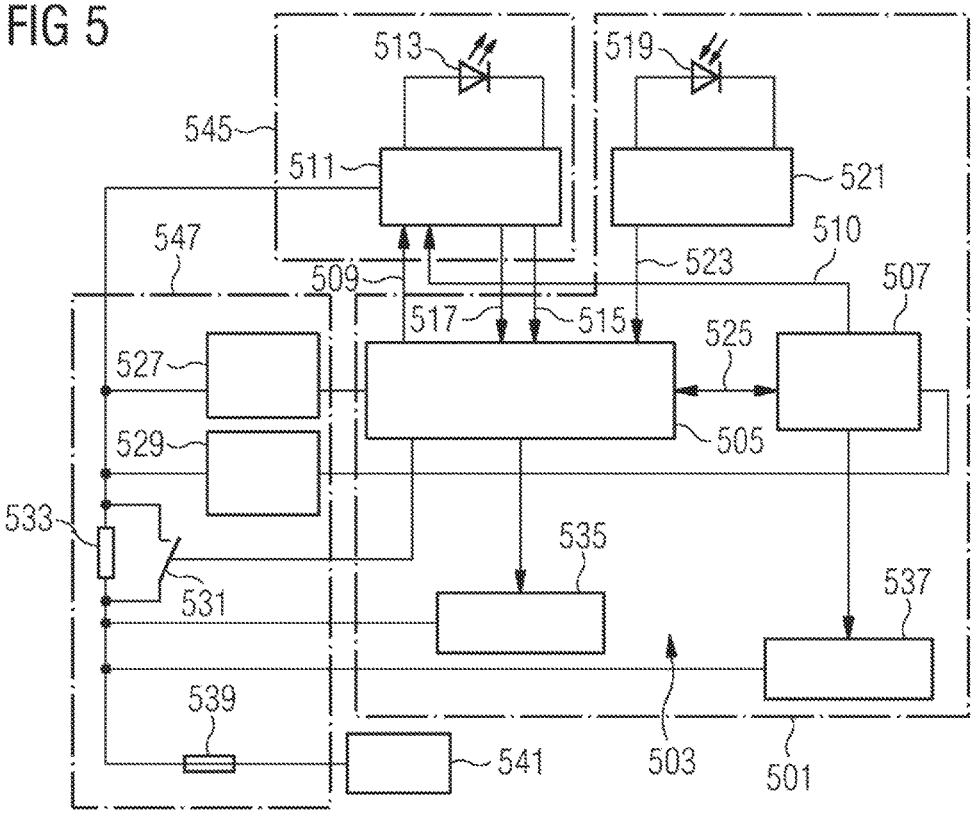

FIG. 5 shows a further device 501 for monitoring a signal emitter comprising a light-emitting diode in a light-signal system.

The device 501 comprises a two-channel control unit 503. The two-channel control unit 503 comprises a first processor 505 and a second processor 507 embodied, for example, as microcontrollers (μC). The first processor 505 is, for example, responsible for the main tasks in the monitoring and can insofar be referred to as a master. The second processor 507 is, in particular, responsible for monitoring functions and can hence in particular be referred to as an "observer", or monitor.

The first processor 505 is, for example, responsible for the actuation 509 of an LED driver 511 (driver circuit) of an LED 513 of a signal emitter, which is not shown in further detail here, of a light-signal system, which is also not shown in further detail here. The actuation 509 of the LED driver 511 uses, for example, pulse width modulation (PWM). Moreover, the first processor 505 measures an LED current 515 and an LED voltage 517. The second processor 507 can also be responsible for the aforementioned actuation. This is identified symbolically with an arrow with the reference number 510.

The device 501 further comprises a photodiode 519 connected to an amplifier 521, which, from the incident light on the photodiode 519, generates an electrical voltage equivalent to the light.

The photodiode 519 measures a light intensity of the light, which is emitted by means of the LED 513. The first processor 505 evaluates the electrical voltage signal of the amplifier 521. Therefore, here, the amplifier 521 transmits an electric voltage signal corresponding to the measured light intensity to the first processor 505. The voltage signal is identified symbolically with an arrow with the reference number 523.

The first processor 505 and the second processor 507 communicate with one another. In particular, the first processor 505 communicates with the second processor 507 in order to determine whether this is still working correctly. This takes place in particular as follows:

The first processor 505 for example induces the communication or initiates the communication by sending a data packet to the second processor 507. If the second processor 507 does not receive a valid data packet for initiating the communication from the first processor 505 within a specific time, it assumes that the first processor 505 is no longer working correctly. If the second processor 507 receives the data, it returns its data on this feedback channel. The valid data packet (the returned data) informs the first processor 505 that the second processor 507 is working correctly.

The communication between the two processors 505, 507 is identified symbolically with a double arrow with the reference number 525 and is, for example, performed via a serial peripheral interface (SPI), which is a bus system.

The first processor 505 is further embodied to switch off the signal emitter, in particular the light-signal system. In particular, the first processor 505 limits an input current for the LED 513. In particular, in an error scenario the first processor 505 switches off the signal emitter, in particular the light-signal system, irreversibly.

The tasks of the second processor 507 are for example the following:

communication with the first processor 505 in order to determine whether it is still working correctly. In particular, the second processor 507 checks a signal path of the light information to the first processor 505 by means of a "monitor validation test". In an error scenario, the second processor 507 switches off the signal emitter, in particular the light-signal system, irreversibly.

The "monitor validation test" is in particular performed as follows:

The photodiode 519 is short-circuited by the second processor 507. As a result, the first processor 505 no longer measures voltage from the amplifier and has to notify this as an error to the observer (second processor 507). If no error is reported, the second processor 507 triggers an EOL signal (EOL=end of life: prevents the signal emitter being switched back on in an error scenario). If the error is reported, the second processor 507 causes the error to be cancelled by the first processor 505. This means, for example, that the first processor 505 is instructed by the second processor to discard the error.

The two processors 505, 507 have their own voltage regulator 527 or 529. Therefore, this means that the two processors 505, 507 are provided with their own voltage regulators 527, 529 so that the failure of one voltage regulator 527, 529 does not affect the two processors 505, 507 simultaneously.

The current-limiting on the part of the first processor 505 is controlled via a switch 531 switched in parallel to a resistance 533.

The current-limiting functions in particular as follows:

At the time of switching-on, there is a series resistance (resistance 533) in the supply line which limits the charging current for the capacitors of the photodiode 513. Following a certain time (in the millisecond range, preferably 1 ms to 10 ms), an electronic switch bridging the series resistance 533 is closed (i.e. with a low-impedance short-circuit).

In the event of an error, the two processors 505, 507 have, independently of one another, the possibility of using an respective EOL signal 535 and 537 (EOL=end of life: prevents the signal emitter being switched back on in an error scenario) to produce a short-circuit, which triggers an upstream fuse 539. This means that the first processor 505 is able to emit an EOL signal 535. The second processor 507 can send an EOL signal 537 in an error scenario.

The reference number 541 indicates a connector to which electrical supply line can be connected or attached.

For the sake of clarity, the individual function blocks according to the block diagram in FIG. 5 have been subdivided once again. The elements according the frame 545 are assigned to the diode. The elements according to the frame 547 are assigned to a voltage or current supply for the device 501.

Therefore, the invention in particular comprises the concept that monitoring of a signal emitter comprising a light-emitting diode is no longer solely based on voltage monitoring, but that the optical monitoring of the light and additionally in particular the electrical current through the LED also include a switch-off decision. This is because when, for example, only electrical current is monitored, there is a considerable hazard potential. This because, with increasing age and/or also thermal stress, with the same power consumption, LEDs lose brightness. This means that solely the monitoring of power consumption does not enable it to be ensured that the LED continues to emit light with the same brightness.

Therefore, according to the invention, in particular a part of the LED light is, for example, diverted via a fiber-optic conductor to a photodiode where it is evaluated.

In order reliably to determine that the detected light also actually originates from the LED and not, for example from light penetrating from outside (extraneous light), according to one embodiment, the LED is periodically switched off for a very short period (millisecond range). This transition from "light Phase" (switched-on LED) to "dark phase" (switched-off LED) is measured. The results provide information as to whether the light originates from the LED and how high the light flux (brightness) in the "light phase" is. The "dark phase" has the further advantage that the extraneous light signal can be measured in this time and hence the light flux of the LED can be measured by means of simple subtraction (see FIG. 4). And, the case of insufficient light flux, for example due to a high ambient temperature or ageing, it is provided according to one embodiment, that the brightness is re-adjusted.

In order to guarantee a high degree of safety, two microprocessors that monitor one another are used (see FIG. 5).

According to one embodiment, the two processors are supplied via their own voltage regulators so that a failure does not affect the two processors simultaneously. One of the processors is for example the master processor (master). The other is, for example, the observer processor (observer).

The master's tasks:

actuation of the LED driver measurement of the LED current and the LED voltage evaluation of the light information via the amplifier communication with the observer microprocessor in order to determine whether this is still working correctly switching-off of the signal emitter, in particular the light-signal system acquisition of an ambient temperature input current limitation in an error scenario, the master switches off the signal emitter, in particular the light-signal system, irreversibly.

The observer's tasks:

communication with the master in order to determine whether it is still working correctly checking the signal path of the light information to the master by means of a "monitor validation test"

in an error scenario, the observer switches off the signal emitter, in particular the light-signal system, irreversibly.

In an error scenario, the two processors independently of one another have the possibility of producing a short-circuit that triggers an upstream fuse via an electronic switch.

Therefore, the inventive step in particular lies in the incorporation of optical monitoring of the light in the error monitoring of the signal emitter in addition to the monitoring of at least one electrical parameter and hence the achievement of higher reliability.

The advantage of this additional monitoring is in particular increased safety. Voltage alone does not provide any information as to whether enough light, or even any light at all, is being emitted.

The possibility of re-adjusting the brightness makes it possible for the signal emitter to remain in operation for longer.

An error is in particular present if the measured actual light intensity is lower than a predetermined light-intensity threshold, in particular when additionally the light intensity can no longer be regulated to a predetermined greater desired light intensity.

Although the invention was illustrated and described in more detail by the preferred exemplary embodiments, the invention is not restricted by the disclosed examples and other variations can be derived therefrom by the person skilled in the art without leaving the scope of protection of the invention.

The invention claimed is:

1. A device for monitoring a signal emitter having a light-emitting diode for a light-signal system, the device comprising:

a measuring unit disposed to measure an actual light intensity of light emitted by the diode and to measure at least one electrical parameter of the diode;

a two-channel control unit configured to operate the signal emitter in dependence on a measured actual light intensity and a measured electrical parameter;

said control unit including a first processor and a second processor, said first processor being configured to actuate a driver circuit of the diode on a basis of the measured actual light intensity and the measured electrical parameter, and said second processor being configured to monitor said first processor during operation for an error and, on detecting an error, to switch off the diode.

2. The device according to claim 1, wherein each of said first and second processors is provided with a respective voltage regulator for a respective electrical supply voltage for said first and second processors.

3. The device according to claim 1, wherein said second processor is configured to switch off the diode for a function test on said first processor, and wherein said second processor is configured, in an absence of an error message from the first processor indicating that the diode is not functioning, to prevent the diode from being switched back on.

4. The device according to claim 1, wherein said first processor is configured to send a data packet to said second processor and, in an absence of a response packet from said second processor, to switch off the diode and/or wherein said second processor is configured to send a data packet to said first processor and, in an absence of a response packet from said first processor, to switch off the diode.

5. The device according to claim 1, wherein said control unit is configured to regulate the actual light intensity to a predetermined greater desired light intensity if the measured actual light intensity lies below a predetermined light-intensity threshold.

6. The device according to claim 5, wherein said control unit is configured to switch off the signal emitter if the actual light intensity cannot be regulated to the predetermined desired light intensity.

7. The device according to claim 1, wherein:

said measuring unit comprises a light sensor; and said control unit comprises a processing unit, said processing unit being configured to subtract a light signal measured by said light sensor when the diode is switched off from a light signal measured by said light sensor when the diode is switched on, in order to form a subtracted light signal representing the measured actual light intensity.

8. The device according to claim 7, wherein, in order to measure the light signals when the diode is switched off and switched on, respectively, said control unit is configured to switch the diode on and off periodically, with a period lying within a millisecond range.

9. The device according to claim 1, which comprises a temperature sensor disposed to measure an ambient temperature of an environment of the signal emitter, wherein said control unit is configured to operate the signal emitter as a function of the ambient temperature.

10. The device according to claim 1, wherein said measuring unit comprises a light sensor, and a fiber-optic conductor disposed to conduct a part of the emitted light to said light sensor.

11. A method for monitoring a signal emitter of a light-signal system, the signal emitter having a light-emitting diode, the method comprising:

measuring an actual light intensity of light emitted by the diode and measuring at least one electrical parameter of the diode;

operating the signal emitter in dependence on a measured actual light intensity and a measured electrical parameter;

actuating a driver circuit of the diode with a first processor on a basis of the measured actual light intensity and the measured electrical parameter; and using a second processor for monitoring the first processor during operation for an error, and, on detecting an error, switching off the diode with the second processor.

12. The method according to claim 11, which comprises providing a respective electrical supply voltage for each of the first and second processors by its own voltage regulator.

13. The method according to claim 11, which comprises using the second processor to switch off the diode for a function test on the first processor and, in an absence of an error message from the first processor indicating that the diode is not functioning, to prevent the diode from being switched back on.

14. The method according to claim 11, which comprises performing one or both of the following steps:

sending a data packet from the first processor to the second processor and, in an absence of a response packet from the second processor, switching off the diode with the first processor; and/or sending a data packet from the second processor to the first processor and, in an absence of a response packet from the first processor, switching off the diode with the second processor.

15. The method according to claim 11, wherein the operating step comprises regulating the actual light intensity to a predetermined greater desired light intensity if the measured actual light intensity lies below a predetermined light-intensity threshold.

16. The method according to claim 15, which comprises switching off the signal emitter if the actual light intensity cannot be regulated to the predetermined desired light intensity.

17. The method according to claim 11, which comprises measuring the light signal with a light sensor, and subtracting a light signal measured by the light sensor when the diode is switched off from a light signal measured by the light sensor when the diode is switched on in order to form a subtracted light signal corresponding to the measured actual light intensity.

18. The method according to claim 17, which comprises, for measuring the light signals with a switched-off and switched-on diode, respectively, switching the diode on and off periodically with a period lying within the millisecond range.

19. The method according to claim 11, which comprises measuring an ambient temperature of an environment at the signal emitter and operating the signal emitter in dependence on the measured ambient temperature.

20. The method according to claim 11, which comprises measuring the light with a light sensor and conducting a part of the light emitted to the light sensor by way of a fiber-optic conductor.

21. A signal emitter, comprising:

a signal chamber including a light-emitting diode; and a device according to claim 1.

22. A computer program product, comprising: a non-transitory computer-readable medium storing computer-readable program code configured to cause a computer to carry out the method according to claim 11 when the computer program code is executed on the computer.

* * * * *